US008312876B2

(12) United States Patent
Mutze et al.

(10) Patent No.: US 8,312,876 B2
(45) Date of Patent: Nov. 20, 2012

(54) RESPIRATOR

(75) Inventors: Andreas Mutze, Schönbuch (DE); Roman Skov, Stuttgart (DE)

(73) Assignee: Moldex-Metric Ag & Co. KG, Walddorfhaslach (DE)

( * ) Notice: Subject to any disclaimer, the term of this patent is extended or adjusted under 35 U.S.C. 154(b) by 791 days.

(21) Appl. No.: 12/442,881

(22) PCT Filed: Oct. 8, 2008

(86) PCT No.: PCT/EP2008/008501

§ 371 (c)(1), (2), (4) Date: Apr. 29, 2009

(87) PCT Pub. No.: WO2010/040368

PCT Pub. Date: Apr. 15, 2010

(65) Prior Publication Data

US 2010/0132712 A1 Jun. 3, 2010

(51) Int. Cl.

| | |
|---|---|
| ***A62B 7/10*** | (2006.01) |
| ***A62B 19/00*** | (2006.01) |
| ***A62B 23/02*** | (2006.01) |
| ***A62B 9/04*** | (2006.01) |
| ***A62B 18/08*** | (2006.01) |

(52) U.S. Cl. ..... 128/201.25; 128/202.27; 128/206.17

(58) Field of Classification Search ..... 128/201.13, 128/201.25, 202.27, 203.29, 205.25, 205.27–205.29, 128/206.12, 206.17, 206.21, 206.28; 55/315, 55/342, 482, 485, DIG. 33, DIG. 35; 96/133–135, 96/147

See application file for complete search history.

(56) References Cited

U.S. PATENT DOCUMENTS

| | | | | |
|---|---|---|---|---|
| 2,951,551 | A * | 9/1960 | West | 96/133 |
| 6,467,481 | B1 * | 10/2002 | Eswarappa | 128/206.17 |
| 6,860,267 | B2 * | 3/2005 | Capon et al. | 128/206.15 |
| 7,213,595 | B2 * | 5/2007 | Capon et al. | 128/205.27 |
| 7,311,764 | B2 * | 12/2007 | Friday et al. | 96/134 |
| 2010/0224190 | A1 * | 9/2010 | Tilley et al. | 128/204.21 |

FOREIGN PATENT DOCUMENTS

| | | |
|---|---|---|
| WO | 00/66248 | 11/2000 |
| WO | 03/090873 | 11/2003 |

OTHER PUBLICATIONS

The Merriam-Webster Dictionary, definition of accommodate, http://www.merriam-webster.com/dictionary/accommodate, last visited May 16, 2012, 3 pages total.*

PCT/EP2008/008501 International Search Report of the International Searching Authority mailed Jun. 18, 2009, 4 pages.

EP 07 01 8111 European Search Report dated Feb. 25, 2008, 2 pages.

* cited by examiner

*Primary Examiner* — Oren Ginsberg

(74) *Attorney, Agent, or Firm* — Michael Best & Friedrich LLP

(57) ABSTRACT

Described is a respirator (1) comprising a mask body (2) which can be used in a universal and constructionally simple way. To this end a first holder (4) is provided for a first filter material (5), which holder is to be detachably fastened to the mask body (2) via a first fastening device (9). The first holder (4) is to be detachably connected via a second fastening device (16) to a second holder (6) for a second filter material (7).

7 Claims, 4 Drawing Sheets

RESPIRATOR

The present invention refers to a respirator.

Respirators are known in very different technical designs and for the most different pollutant filters. For instance, EP-A-893141 shows a respirator which contains both filter material for filtering gaseous pollutants and filter material for filtering particulate pollutants (dusts). To this end the known respirator comprises a mask body and a housing to be detachably fastened to the mask body, in which a filter system is accommodated. The filter system consists preferably of a particulate filter in the form of a folded nonwoven of a predetermined pore size and of a gas filter, preferably one of the standard activated carbon filters. The housing is connected with a fastening device, in the illustrated example a thread, to the mask body. The thread is provided on the outside of a connecting piece on the housing, through the inside of which the filtered air passes into the mask body to be breathed in by the user. The side of the housing that is opposite the connecting piece is closed by a lid, which is provided on its upper side with a recess, which terminates in a perforated bottom through which the air passes into the interior of the housing. A fan which is to facilitate the entry of air into the housing and thus into the mask body is provided above the perforated bottom. It is true that in theory the known respirator can also be used with only one single filter material, but the housing will then encompass a large hollow space, which may have the consequence that the other filter material is shifted from its correct seat and bypass gaps for the air will open around the filter material.

It is the object of the present invention to provide a respirator that can be universally used for different purposes of use.

The object is achieved with the features specified in claim 1.

The design according to the invention creates a filter system that can be assembled in a simple way, depending on the requirements, without the risk of malfunctions. Since the second filter material is provided in a separate holder, it can be added to the first filter material in case of need, or the respirator mask is only used with the first filter material.

Advantageous developments of the invention become apparent from the subclaims.

The compatible design of the fastening devices between the mask body and the first holder on the one hand and the first holder and the second holder on the other hand is of particular advantage. It is thereby possible that the second filter material can also be used alone together with the mask body.

Compatibility is preferably achieved through corresponding connection elements and complementary connection elements on the components to be fastened to one another.

This configuration can be realized particularly easily in terms of construction when the first holder is configured as a housing with a bottom and a cover that are provided with the corresponding connection elements and complementary connection elements, respectively.

Owing to the single air inlet opening, whose opening cross-section encompasses the whole necessary cross-section of the passage flow for air introduction, i.e. omission of perforated bottoms or mesh fabrics, or the like, air can be introduced in concentrated form at one place, so that the sealing problems can be minimized in the area of the fastening device.

It is ensured through the arrangement of air guiding channels that the air inhaled by the user is distributed over the whole cross-section of the filter.

Preferably, the first holder is configured for accommodating a gas filter, particularly in the form of a cartridge, and the second holder for accommodating a particulate filter, particularly a filter pad.

The two holders and the cover can be manufactured and provided separately, for instance for providing a substitute or for offering different filter qualities or for retrofitting already existing respirators.

An embodiment of the invention shall now be explained in more detail with reference to the drawings, in which.

Figure 1:
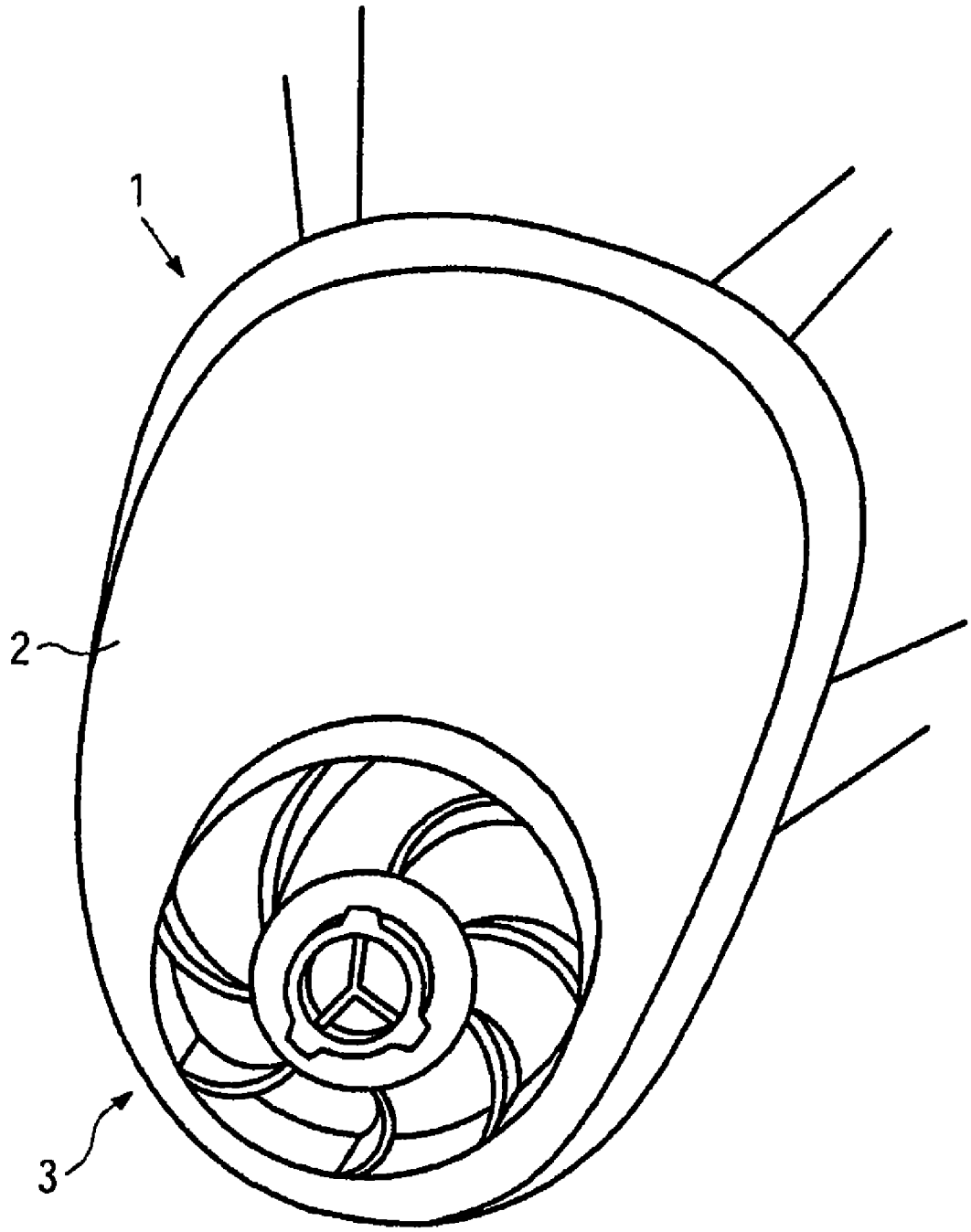
FIG. 1 is a perspective schematic view of a respirator according to the invention with a first holder.

FIG. 1 shows a respirator 1 according to the invention, the respirator being configured in the illustrated embodiment as a full mask with a mask body 2 covering the whole face, i.e. mouth and nose as well as eyes and at least parts of the forehead and check areas. The mask body 2, however, may also be one of the standard half masks that just reach over mouth and nose. A great variety of mask bodies are known and need not be explained once again.

Furthermore, the respirator 1 according to the invention includes a filter device 3 which is preferably detachably fastened to the mask body 2 so as enable, for instance, an exchange of the filter material.

In the illustrated embodiment the filter device 3 comprises a first holder 4 for a first filter material 5 and a second holder 6 for a second filter material 7. The first filter material 5 is preferably a filter material that can be used for gaseous pollutants, for instance activated carbon, and is present in the form of standard cartridges that can be exchanged much more easily than would be possible with loose material.

The second filter material 7 is preferably a particulate filter and contains one or more pleated or flat sheet materials, for example non-woven materials or the like, the pore size of which is matched to the size of the particles to be filtered out.

The first holder 4 is configured as a housing, for instance in the form of a standard capsule, and includes a container wall 4*a*, a bottom 4*b* and an upper cover 4*c* which is connected to the wall 4*a*. The first filter material 5 is inserted into the holder 4, with spacers 4*d* in the form of ribs keeping the first filter material 5 spaced apart from an air outlet opening 8 which is provided in the bottom 4*b*, preferably at the lowest point of a funnel-shaped bottom 4*b*. The outlet opening 8 is the only outlet for air out of the holder 4 and is detachably connected via a fastening device 9 to the mask body 2.

Figure 4:
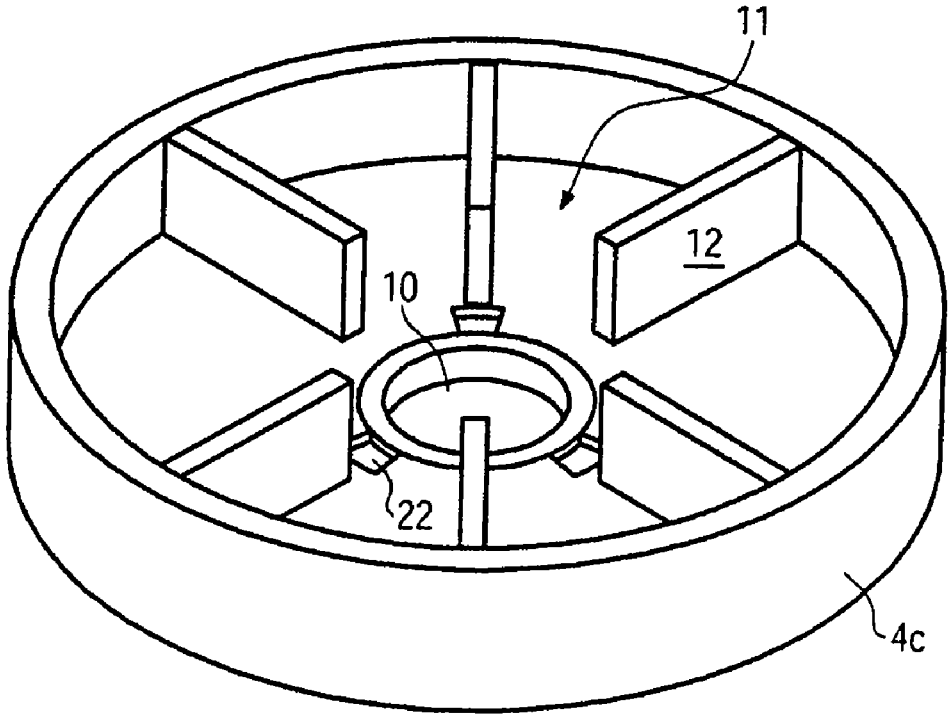
FIG. 4 shows the cover according to FIG. 3 from below (inside)
Figure 5:
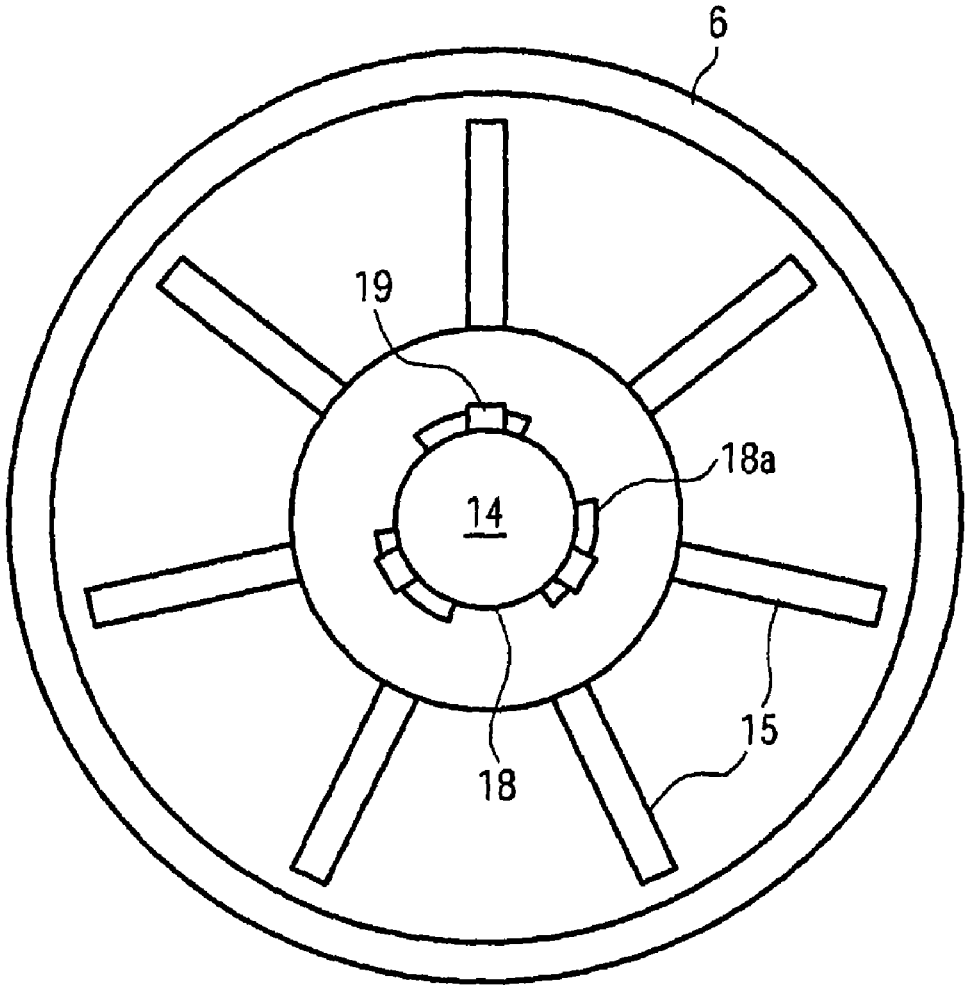
FIG. 5 is a top view on the second holder.
Figure 6:
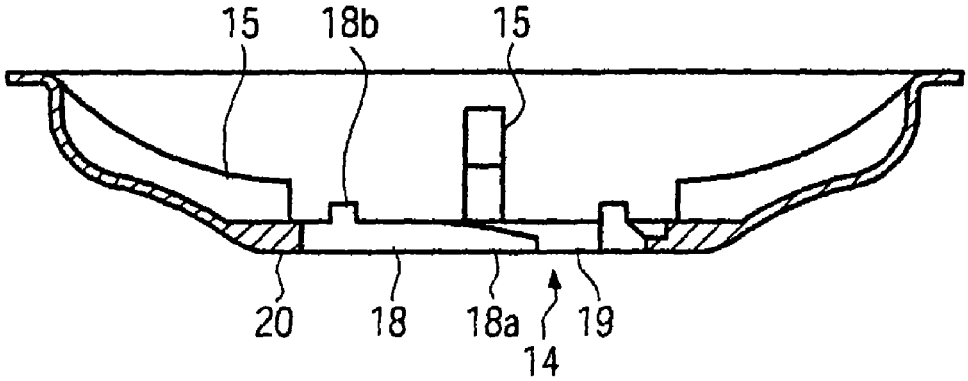
FIG. 6 is a section through the second holder according to FIG. 5.

An air inlet opening 10 is provided in the cover 4*c* in coaxial orientation relative to the outlet opening 8, the air inlet opening 10 also offering the only possibility of introducing air into the first holder 4, the opening cross-section of which thus encompasses the whole necessary inlet cross-section. Hence, the air inlet opening 10 is relatively large. The air inlet opening 10 has assigned thereto on the inside of the cover 4*c*, i.e. at the side facing the first filter material 5, at least one air distribution channel 11 (FIG. 4) which extends from the air inlet opening 10 over the whole cross-section, transverse to the inflow direction, of the first filter material 4. In the illustrated embodiment a plurality of air guiding channels 11 are provided that are formed by radially extending ribs 12 which project from the cover 4*c* towards the first filter material 5 and preferably simultaneously keep the filter material 5 in situ. The air guiding channels ensure a uniform distribution of the air flowing in through the air inlet opening 10, over the holder 4. Further ribs 13 that in the illustrated embodiment extend in spiral form around the air inlet opening 10 are provided on the upper side and outer side, respectively, of the cover 4*c*.

Figure 2:
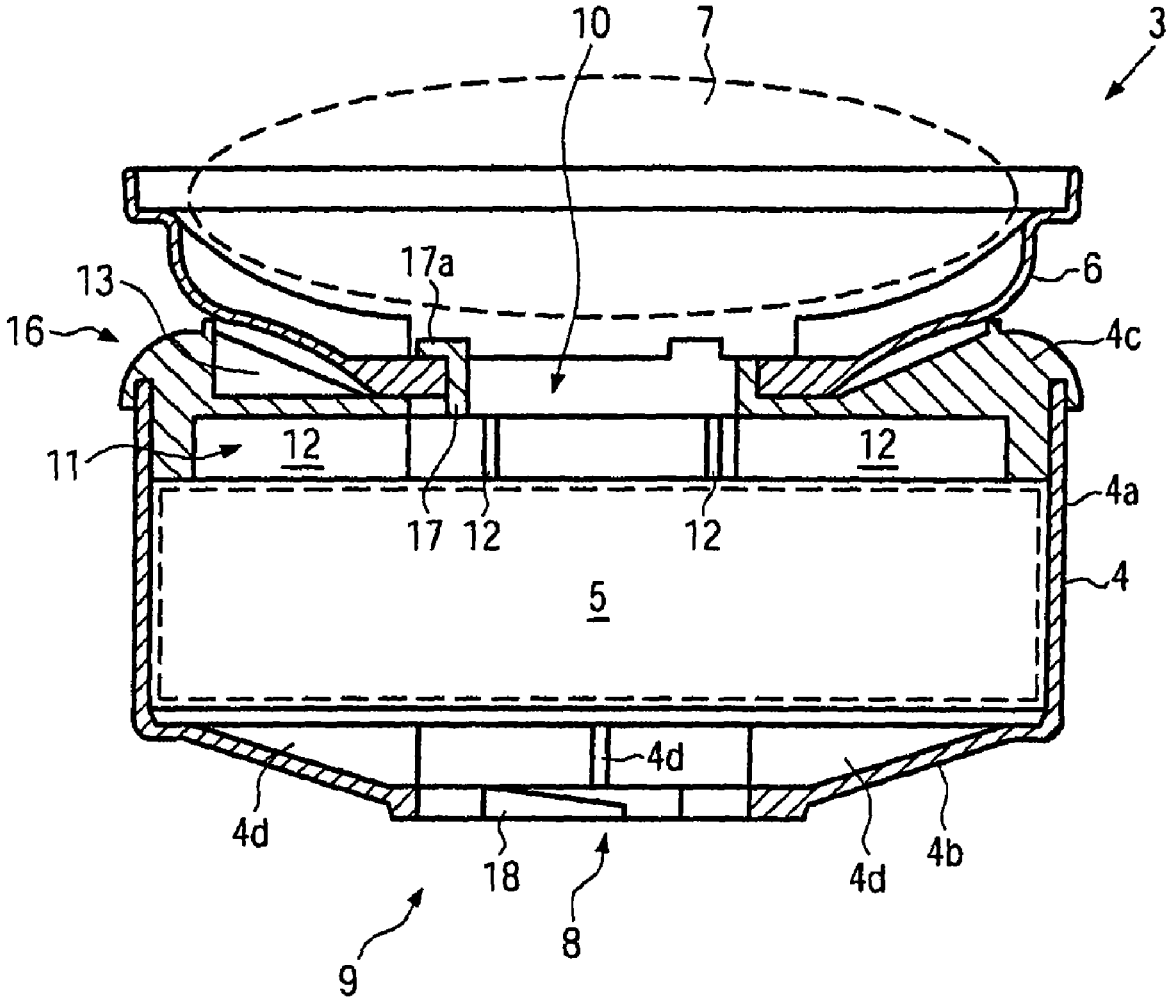
FIG. 2 is a section through a first and a second holder of the respirator according to the invention.
Figure 3:
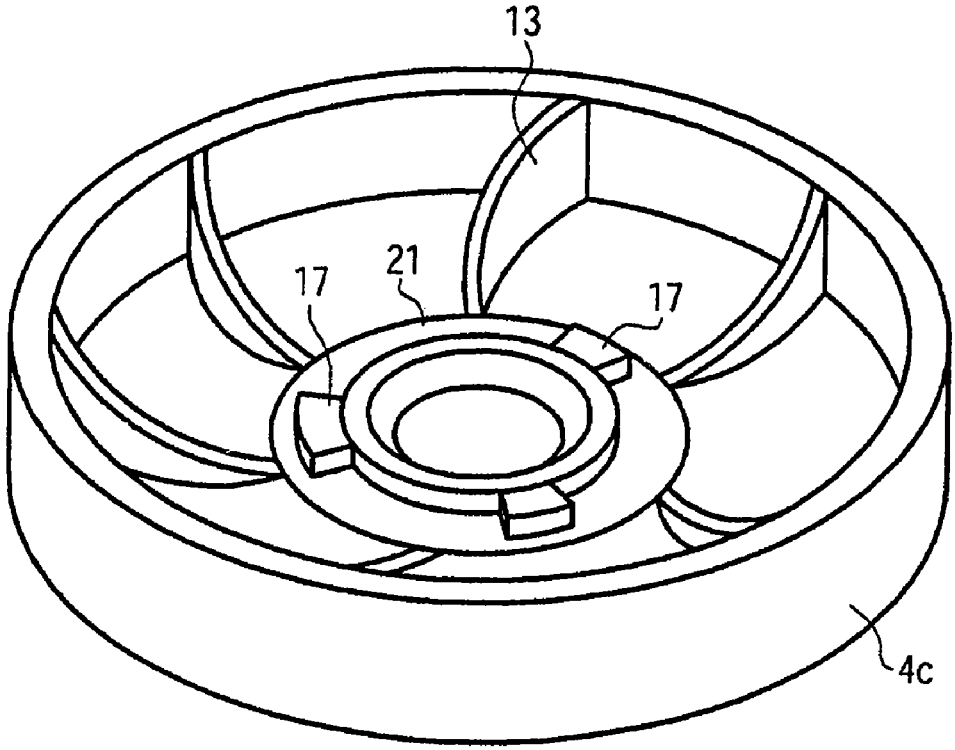
FIG. 3 is a perspective top view from above on a cover of a first holder.

The second holder 6 is preferably configured as a shell-shaped or semi-shell-shaped carrier which accommodates the second filter material 7. The second holder 6 comprises an air outlet opening 14 which in turn is arranged coaxial to the air inlet opening 10 and the air outlet opening 8, respectively, in the mask body 2 and has about the same size. In the interior of the second holder 6 spacer ribs 15 are provided again that keep the second filter material, e.g. the filter pad shown in FIG. 2, at a distance from the air inlet opening 14. The second filter material 7 is preferably firmly connected to the second holder 6 and is exchanged together with said holder. However, a mount or a kind of housing may also be provided on the second holder 6 for detachably holding the second filter material 7.

The first holder 4 and the second holder have arranged thereinbetween a second fastening device 16 with which the second holder 6 can be fastened to the first holder 4 and can be detached therefrom again, so that the mask body 2 can selectively be used only with the first holder 4 or with the complete filter system 3 composed of first and second holders 4 and 6.

For an application where the mask body 2 can also be used only with the second holder 6 and the filter material 7 contained therein, the fastening devices 9 and 16 are compatible, i.e. the second holder 6 can be fastened to the first holder 4 and also directly to the mask body 2. Preferred fastening devices 9, 16 show a combination between a rotating fastening in the manner of a bayonet lock and a clamping and/or locking engagement.

Each fastening device 9, 16 comprises connection elements 17 and complementary connection elements 18, the connection elements and the complementary connection elements 17, 18 meeting each other at each connection point. It does not matter which element of the fastening device 9 and 16, respectively, is defined as the connection element and which element as the complementary connection element. In the illustrated embodiment at least one hook-like component is defined as the connection element 17 that comprises a head 17*a* gripping thereover, which is oriented away from the respective air opening and forms under itself a free space for accommodating a complementary connection element 18. A plurality of hooks are preferably provided and evenly distributed around one of the air openings.

The complementary connection element 18 contains at least one, but preferably a plurality of webs that are arranged and distributed around a corresponding air opening such that recesses 19 positioned between the webs permit the passage of the heads 17*a* of the connection elements 17. Each web projects in radial direction into an air opening and is surrounded at the side opposite the air opening by a sealing surface 20 which is arranged at the side facing the connection element 17 during use, the connection elements 17 being also surrounded by a sealing surface 21 which gets in sealing engagement with the sealing surface 20 when connection elements 17 and complementary connection elements 18 are in engagement with one another.

The webs of the complementary connection elements 18 comprise an inclined inlet portion 18*a* which is arranged at that side of the webs 18 that first passes underneath an associated head 17*a* of the connection elements 17 and more and more reduces the distance between the web 18 and the head 17*a* in the course of its relative movement. At the rear end the webs 18 contain a stop 18*b* that abuts on the associated head 17*a* when the connection elements 17 and the complementary connection elements 18 are in optimal engagement with each other. The connection elements and the complementary connection elements are preferably made of a material that is elastically deformable to some extent, so that also owing to the inclined inlet portion 18*a* the two sealing surfaces 20 and 21 are firmly pressed against each other when the connection elements and the complementary connection elements 17, 18 are in full engagement with each other. Openings 22 are provided in the sealing surface 21 underneath the heads 17*a*.

In the illustrated embodiment the fastening devices 9 and 16 are illustrated such that the mask body is provided with the connection elements, i.e. the heads 17*a* projecting in the form of a bayonet, and the sealing surface 21. As a consequence, the bottom 4*b* of the first holder 4 contains the complementary connection elements 18, i.e. the webs with the sealing surface 20. The cover 4*c* of the first holder 4 on its part contains the connection elements 17 with the heads 17*a* projecting in the manner of a bayonet and the sealing surface 21, while the second holder 6 comprises the complementary connection elements 18, i.e. the webs with the sealing surface 20. It is in this way that both the first holder 4 alone and the second holder 6 alone are each connected to the mask body 2, and a combination of the first and the second holder 4, 6 is possible in addition, with the first holder 4 being fastened to the mask body and the second holder 6 to the first holder 4.

For connecting and locking the two fastening devices 9 and 16 the two parts 2, 4, 6 to be fastened are axially pressed against one another such that the heads 17*a* immerse into the spaces 19 between the webs until the sealing surfaces 20 and 11 abut on each other. The two parts are then rotated relative to each other, so that the webs with the advancing inclined inlet portion 18*a* move under the heads 17*a*, and on account of the inclined inlet portion 18*a* they establish a friction connection that is getting tighter and tighter. The rotation will be completed when the stop 18*b* abuts on one of the heads 17*a*.

In a modification of the described and depicted embodiment the fastening devices can also be implemented by lock- or snap-type connections alone. The holder may have any appropriate shape that is suited for the respectively used filter material. The holders are expediently made from plastics, but may also be made from any other material.

The invention claimed is:

1. A respirator (1) comprising a mask body (2) and a first holder (4) for a first filter material (5) which is to be detachably fastened to the mask body (2) via a first fastening device (9) and is to be detachably connected via a second fastening device (16) to a second holder (6) for a second filter material (7); wherein:

the first and the second holder (4, 6) each hold only one filter material (5,7);

the first filter material is a gas filter (5) and the second filter material is a particulate filter (7); and the first and second fastening devices (9, 16) are made compatible, so that the second holder (6) for the second filter material (7) can selectively be fastened to both the first holder (4) and the mask body (2).

2. The respirator (1) according to claim 1, characterized in that each of the first and second fastening devices (9, 16) comprises a connection element (17) and a complementary connection element (18), the mask body (2) comprising a first connection element (17), the second holder (6) comprising a first complementary connection element (18), and the first holder (4) comprising both a second connection element (17) and a second complementary connection element (18).

3. The respirator (1) according to claim 2, characterized in that the first holder (4) is configured as a housing with a bottom (4*b*) and a cover (4*c*), the bottom (4*b*) comprising the second complementary connection element (18) and the cover (4c) comprising the second connection element (17).

4. The respirator (1) according to claim 1, characterized in that the first holder (4) comprises a single air inlet opening (10).

5. The respirator (1) according to claim 1, characterized in that air guiding channels (11) are provided on an inside of the first holder (4), the channels extending from an air inlet opening (10) over the cross section of the first filter material (5).

6. The respirator (1) according to claim 2, characterized in that the first holder (4) is configured as a housing with a bottom (4*b*) and a cover (4*c*), the cover (4*c*) being provided with a single air inlet opening (10), and the second connection element (17) being provided on the cover (4*c*) in the area of the air inlet opening (10) and the second complementary connection element (18) being provided on the bottom (4*b*).

7. The respirator (1) according to claim 2, characterized in that the second holder (6) for the second filter material (7) for the selective detachable fastening to the first connection element (17) of the respirator (1) is configured as a shell-shaped carrier for accommodating a filter pad (7), which is provided with the first complementary connection element (18).

* * * * *